US006767228B2

(12) United States Patent
Katz

(10) Patent No.: US 6,767,228 B2
(45) Date of Patent: Jul. 27, 2004

(54) INTERNAL SAFETY COVER AND METHOD TO PREVENT ELECTRICAL SHOCK

(76) Inventor: Irwin G. Katz, 59 Westview Rd., Wayn, NJ (US) 07470

( * ) Notice: Subject to any disclaimer, the term of this patent is extended or adjusted under 35 U.S.C. 154(b) by 0 days.

(21) Appl. No.: 10/160,366

(22) Filed: May 31, 2002

(65) Prior Publication Data

US 2002/0182907 A1 Dec. 5, 2002

Related U.S. Application Data

(60) Provisional application No. 60/295,334, filed on Jun. 1, 2001.

(51) Int. Cl.[7] ..... H01R 13/44
(52) U.S. Cl. ..... 439/140; 439/134
(58) Field of Search ..... 439/140, 141, 439/144, 131, 137; 174/67; 200/51.09; 361/93

(56) References Cited

U.S. PATENT DOCUMENTS

| | | | | | |
|---|---|---|---|---|---|
| 3,575,684 | A | * | 4/1971 | McIntyre | 439/140 |
| 4,865,554 | A | * | 9/1989 | Matsuoka et al. | 439/70 |
| 5,030,119 | A | | 7/1991 | Lowe | 439/141 |
| 5,507,656 | A | * | 4/1996 | Ales | 439/133 |
| 5,813,873 | A | | 9/1998 | McBain et al. | 439/145 |
| 5,934,917 | A | | 8/1999 | Haut | 439/131 |
| 5,946,180 | A | * | 8/1999 | Simpson | 361/93.3 |
| 5,989,052 | A | | 11/1999 | Fields et al. | 439/373 |
| 5,998,735 | A | | 12/1999 | Patterson, Jr. | 174/67 |
| 6,036,536 | A | | 3/2000 | Chiu | 439/536 |
| 6,051,788 | A | | 4/2000 | Nichols | 174/67 |
| 6,086,390 | A | | 7/2000 | Haut | 439/131 |
| 6,086,391 | A | * | 7/2000 | Chiu | 439/145 |
| 6,159,034 | A | | 12/2000 | Royer | 439/373 |
| 6,183,264 | B1 | | 2/2001 | Harsayni | 439/38 |
| 6,229,107 | B1 | | 5/2001 | Flint et al. | 200/51.09 |
| 6,425,773 | B2 | | 7/2002 | Mosebach et al. | 439/137 |
| 2002/0104745 | A1 | | 8/2002 | Allison | 200/51.09 |

* cited by examiner

*Primary Examiner*—Chandrika Prasad
(74) *Attorney, Agent, or Firm*—Gary P. Katz

(57) ABSTRACT

This invention is an internal safety cover for use in electrical outlets that provides increased protection against electrical shock. The internal safety cover is designed to be slidably positioned inside the conductive members of an electrical outlet. One embodiment requires uniform force to both openings in the socket for the safety cover to slide and permit the plug to gain contact with the conductive members. Furthermore, the compression device can be adapted to eject partially inserted or withdrawn plugs. A latch mechanism embodiment may lock the safety cover in the closed position preventing access even with uniform force. This invention provides automatic safety protection from both improper foreign objects and partially inserted or withdrawn plugs.

23 Claims, 5 Drawing Sheets

INTERNAL SAFETY COVER AND METHOD TO PREVENT ELECTRICAL SHOCK

This application claims the benefit of U.S. Provisional Application No. 60/295,334 filed Jun. 1, 2001.

FIELD OF THE INVENTION

This invention relates generally to the field of electrical outlets and/or junction devices that facilitate the interconnection of male and female type connectors for connecting electrical power, communication or other services. More specifically, this invention relates to an internal safety device adapted to fit inside a junction device or the socket body of an electric outlet.

BACKGROUND OF THE INVENTION

Referring to FIGS. 1, and 1A, the conventional electrical outlet 15 generally comprises a switch plate 1, a socket 3, a combined fixing metal plate and grounding member 5, a housing 7 and a pair of conducting members 9. At a minimum, an electrical outlet must contain a socket 3 and at least one conductive member 9.

Efforts have been made since the initial development of electrical power for the home and industry, to provide safe utilization of electrical power without endangering the users. While the nominal 110 volts provided at most household electrical outlets is generally not fatal when encountered by an adult in good condition, it is nonetheless dangerous, and can be fatal. Furthermore, some countries and industries require 220 volts which increases the risk of fatal electric shocks. Therefore, it has become customary to construct many of the components of electrical systems and devices that a person is likely to encounter, of electrically non-conductive materials (i.e., plastic).

Nonetheless, it is still possible to receive an electric shock through intentional or inadvertent contact with the electrically active contacts within the receptacle itself. This is recognized as a significant hazard in households and businesses with toddlers and small children. This hazard has led to the development of various devices for locking electrical plugs to an outlet to preclude a child from disengaging the plug and having access to the outlet. Furthermore, various receptacle covers or guards have been developed in the past for covering unused receptacles.

Still, the conventional electrical receptacle provides little shielding for the receptacle contacts, which are generally recessed only about one-eighth of an inch from the face of the receptacle. Considering that the contact prongs of the typical 110 volt electrical appliance are about five-eighths of an inch long, the two electrical prongs of a conventional electrical appliance plug may be conducting electricity from an outlet receptacle with as little as one-eighth of an inch of each prong inserted into the receptacle. Alternatively, about one-half inch of each of the prongs may be exposed during insertion and removal of an electrical plug into or from an outlet, and still be conducting electricity to the electrical appliance connected to the plug. This poses a significant hazard to a person manipulating the plug, as oftentimes the prongs provide a tight fit into a receptacle, and many plugs are difficult to grip at other than the extreme base, where one's fingers may contact the prongs.

Another problem encountered with standard electrical outlets is that children frequently try to insert foreign objects into the openings designed for an electrical plug. There is an obvious danger involved in any such attempted improper use of an electrical outlet by a child. Any improper touching of an inappropriate object inserted into an outlet can lead to the potential of electrical shock.

Protecting individuals from such potential electrical dangers is not a simple or easy task. The exposed opening of an electrical outlet makes the electrical power accessible to small children inserting objects into the outlet. Moreover as long as prongs are exposed a touch hazard exists. Unfortunately, for children the temptation and hazard always exists.

In an attempt to alleviate this problem, certain devices have been conceived to prevent children from playing with such electrical plugs in the electrical outlets. One such known protective device is an external safety plug consisting of a flat face member having two male prongs, the entire device generally being comprised of a non-conducting material. This device is designed to be inserted in an unused electrical outlet to discourage children from placing their fingers or foreign objects into the female outlet receptacles to avoid electrical shock. One limitation of such a device is that children may attempt and may easily pry the device out of an electrical socket thereby, negating its utility completely. Moreover, such insertible devices are not conceived or structured to protect against children prying out an already inserted plug or manipulating a plug to a partially unplugged but live position. As stated above, this latter aspect may be more of a potential danger then the problem of exposed outlets.

One safety device, described in U.S. Pat. No. 6,159,034 is an external safety cover for electrical outlets. This device is mainly to prevent children from pulling out electrical appliance plugs inserted in electrical outlets. The device comprises a door like cover being mounted in a hinged manner to an outlet plate. Unless the cover is locked a child looking to play with something can easily open it. Furthermore, this device does not prevent a child from inserting objects into the electrical outlet.

U.S. Pat. No. 6,051,788 describes a safety plate that is raised to provide a thickness of about one half inch from the underlying surface. This provides some safety protection as electrical outlets are conventionally installed flush with the surface. The safety plate includes one or more recesses corresponding to the one or more electrical receptacles of conventional electrical outlets, with the recesses being dimensioned and configured to provide a close fit about a conventional electrical plug inserted therein. Thus, by the time the contact prongs of the electrical plug have been withdrawn sufficiently from the receptacle for a person to touch the contact prongs, the prongs have been withdrawn sufficiently far from the receptacle so as to break contact with the receptacle contacts, thereby providing safety for a person using the invention. The reverse is also true, that when a plug is being inserted into the receptacle, the non-conductive base of the plug is immediately adjacent to the raised face of the present safety plate before the tips of the plug prongs may make contact with the electrical contacts within the outlet receptacle, thus precluding contact with a "hot" prong of the plug by a user. The problem is that this invention requires use of an external safety plug or receptacle guard to prevent electrical shock from insertion of foreign objects. Such a receptacle guard can be easily removed by a child or inadvertently left off by an adult.

In U.S. Pat. No. 6,086,390 a lift and latch mechanism is described to create a flush/recessable junction device suitable for electrical outlets. However, the device does not provide protection from electrical shock without the use of external safety plugs that are easily removed or inadvertently left open by not inserting the external safety plug. Furthermore, there is the risk of electric shock if the plug is left partially inserted or withdrawn when the electrical outlet is flush with the junction device.

Finally, U.S. Pat. No. 6,183,264 describes a safety outlet receptacle with a corresponding plug that renders the outlet receptacle inactive and unable to transmit an electric current unless activated using the corresponding plug. The problem is that outlet will only work with a corresponding plug. Upgrading to specially manufactured corresponding plug is prohibitively expensive and prevents use of electrical devices without the attached corresponding plug.

None of the prior art, either singly or in combination, provides complete protection from electrical shock from inserted foreign objects or from a partially inserted or withdrawn plug from a safety outlet. There is a need for an electrical outlet safety device that prevents contact with the prongs of an electric plug due to partial insertion or removal of the plug into or from the outlet receptacle. Preferably, this device also provides protection without the use of external safety plugs or receptacle guards. In addition, there is a need to protect from insertion of foreign objects without the use of an external cover or box. Accordingly, there is a need for a new device for protection against all the foregoing dangers. While there are some devices conceived for this protection, the subject device is conceived as an improved device to protect against all such dangers, and the following embodiments of the invention are directed accordingly. The present invention satisfies this need.

SUMMARY OF THE INVENTION

The invention discloses an internal safety cover comprising a backend connected to at least one non-conducting prong. The backend is attachable to the inside of a socket body of an electrical outlet and the prong slidably fits inside a conductive member of said electrical outlet.

In an embodiment of the invention an electrical outlet is disclosed comprising a socket body, at least one conducting member, and an internal safety cover comprising a backend connected to at least one non-conducting prong wherein the backend of the safety cover is attached to the inside of the socket body by a compression device wherein the prong of the internal safety cover is slidably inside the conducting member. Furthermore, a method is disclosed using an electrical outlet and the internal safety cover to provide power while protecting against electrical shock.

BRIEF DESCRIPTION OF THE DRAWINGS

The present invention and its advantages will be better understood by referring to the following detailed description and the attached drawings in which:

FIG. 2(*b*) is a side view illustrating an internal safety cover.

DETAILED DESCRIPTION

The present invention will be described in connection with its preferred embodiments. However, to the extent that the following description and drawings is specific to a particular embodiment or a particular use of the invention, this is intended to be illustrative only, and is not to be construed as limiting the scope of the invention. On the contrary, it is intended to cover all alternatives, modifications, and equivalents that are included within the spirit and scope of the invention, as defined by the appended claims.

The subject invention is an internal safety cover and is primarily directed to wall type electrical outlet sockets that are adapted to receive the prongs of a plug that are connected to an electrical cord leading to an electrical appliance. More specifically this invention is an internal safety device or cover that may be adapted for electrical outlets that receive a prong type electrical plug. This internal safety cover prevents individuals (i.e., children) from inserting objects other than proper electrical plugs into electrical outlets. Furthermore, an embodiment of the internal safety cover prevents plugs from being partially inserted or withdrawn preventing individuals or objects from coming into contact with partially exposed prongs of an appliance plug. Therefore, reducing the potential of electrical shock. The purpose of the present invention is to provide an improved and convenient automatic safety device for wall type electrical outlets. In addition, the internal safety device can be adapted for all junction devices and wall type electrical receptacles and prevents child access to open electrical outlets at any time whether covered or not.

Finally, due to the unique internal nature of the safety device, the safety device cannot easily be tampered with by a child. Another advantage of the subject invention is to provide an improved aesthetical appearing outlet not having empty openings.

The subject invention is an internal safety cover device adapted for placement inside a conventional electrical outlet of the type affixed to a wall or building appurtenance. The subject internal safety cover is an internal device working automatically to protect children and others from inserting foreign objects or fingers into electrical outlets and also coming into contact with exposed active prongs of an electrical plug inserted into female outlet.

Figures 1A, 1B:
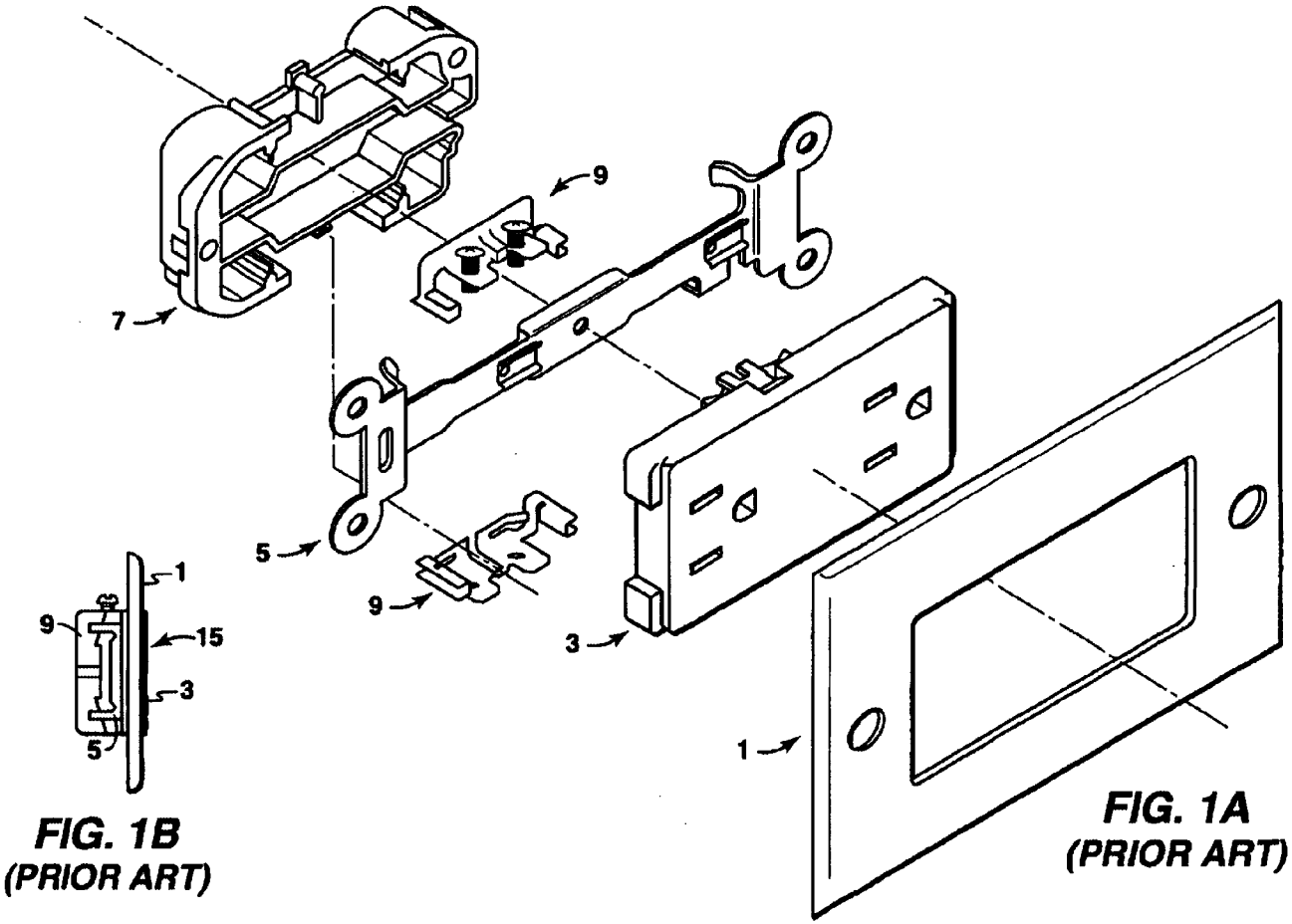
FIG. 1A (PRIOR ART)
FIG. 1B (PRIOR ART)
FIG. 1 is a drawing showing the prior art conventional electrical outlet.
Figure 2A:
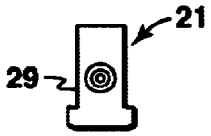
FIG. 2(*a*) is a back view illustrating an internal safety cover.
Figure 2B:
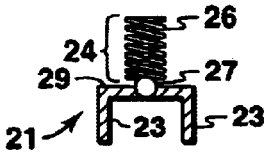

FIGS. 2(*a*) and 2(*b*) illustrates a safety cover 21. The safety cover 21 has at least one male prong 23. FIG. 2(*a*) is a back view illustration showing the backend 29 of the safety cover 21. However, as shown in FIG. 2(*b*), the safety cover 21 preferably has two prongs 23 connected to the backend 29. Most commercially available outlets only have three openings and therefore, there would be no need for more than three prongs unless an outlet has more than three openings. For a conventional electrical outlet the safety cover must have at least two prongs and preferably two prongs to enable all the safety embodiments discussed herein.

Figure 3:
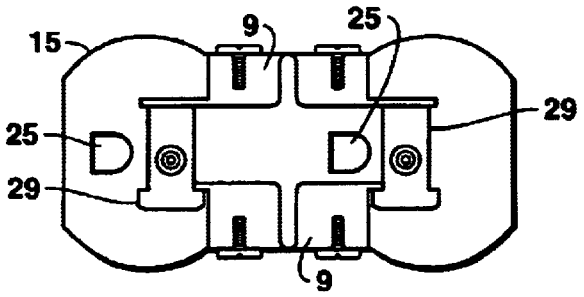
FIG. 3 is a back view showing internal safety cover placement.
Figure 4:
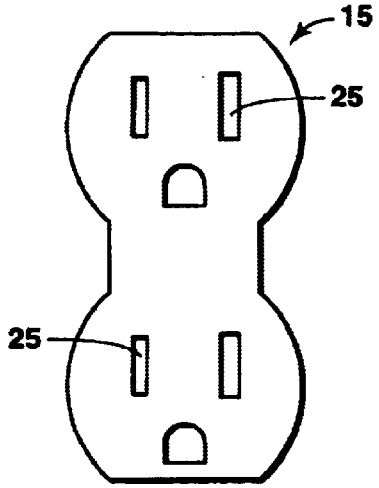
FIG. 4 is a perspective view of an outlet with two internal safety covers illustrating the safety covers in the closed disposition.
Figure 5:
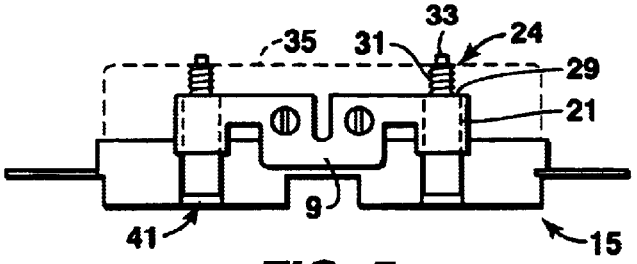
FIG. 5 is a side view of an electrical outlet illustrating two internal safety covers with spring guide, spring, and pivot attached to the safety covers in the open disposition.

FIG. 3 illustrates the placement of the back end 29 of the safety cover 21 inside the electrical outlet 15. One of the prongs 23 of the safety cover 21 may be larger to protect a larger opening 25 in an electrical outlet 15 as shown in FIG. 4. The prongs of the safety cover 21 can be sized and/or adapted to slidably fit inside various size openings 25 and the conductive track of the conductive members 9 of an electric outlet 15 or junction box. The conductive track is the electrical contacts or the area on the conductive member 9 that the prongs of the plug contact when the prongs of the plug are inserted into an electrical outlet. The prongs 23 of the safety cover 21 are preferably a rectangularly shaped component that is slidably sized (can slide inside the conductive track) for insertion into the conductive track of the conducting member 9 of the electric outlet 15. The safety cover 21 is preferably made from non-conducting materials and the prongs must be made from a non-conducting material (i.e., plastic). As shown in FIGS. 4 and 5, the internal safety device 21 is designed to fit inside the conductive track of the conductive member 9 of the electric outlet 15 and the prongs fits insides the apertures or openings 25 of the socket 3.

In one embodiment the internal safety cover 21 is a U shape design as shown in FIG. 2(*b*). A U shaped design permits protection of two openings 25 of the electric outlet 15. FIG. 2(*b*) illustrates a U shaped safety cover with a compression device 27 (i.e., a spring 26 with a spring guide 28) attached to the backend 29 of the safety cover 21. Furthermore, other designs such as, a T-shaped, Y-shaped, or V-shaped backend for the internal safety cover with three prongs would provide an internal cover for all three openings and thus a more aesthetically pleasing electrical outlet.

Figure 6:
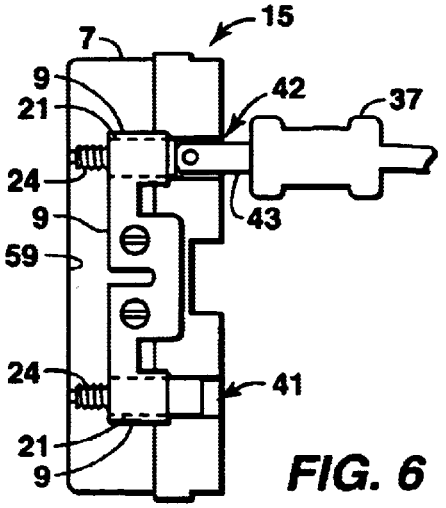
FIG. 6 is a side view of an electrical outlet illustrating two internal safety covers inside an electrical outlet with spring guide, spring and pivot attached to the safety covers with one safety cover in the closed disposition and one safety cover in the open disposition.

FIGS. 5 and 6 are side view illustrations of internal safety covers 21 attached to a springs 31 and the springs 31 are preferably mechanically attached 33 to the rear inside 59 of the housings 7. The spring or compression device 24 is designed to resist but will permit the movement of the safety cover 21 away from the openings 25 of the electrical outlet 15 upon the exertion of proper force. Furthermore, the compression device 24 moves the internal safety cover 21 back into the closed disposition 41 as shown in FIG. 5 from the open disposition 42, as shown in FIG. 6, once force is no longer exerted on the safety cover 21. As discussed below with the absence of force on the safety cover 21 or the absence of an inserted plug 37 the safety cover 21 will be in the closed position 41. Therefore, the natural default disposition of the safety cover 21 is in the closed disposition 41 with the openings 25 and the conductive members 9 protected by the internal safety cover 21.

FIG. 6 illustrates an internal safety covers 21 attached to a spring 31 and the springs 31 are attached to the rear inside 59 of the housing 7. Upon insertion of the prongs 43 of a plug 37 the spring 31 compresses and permits the safety cover to slide towards the rear 59 of the housing 7 away from the openings 25 to the open disposition 42. This permits the plug 37 to contact the now exposed conductive track of the electrical contacts 9 that were previously covered by the safety cover 21. When a plug 37 is removed the spring decompresses forcing the safety cover 21 to slide though the conductive track of the electrical contacts 9 or conductive members to the closed disposition 41. At the closed position 41 the conductive members 9 are covered with a non-conducting internal safety cover 21 preventing electrical shock.

Typically, a spring is used as the compression device. However, another embodiment of the invention is the use of a piston instead of a spring. The piston is attached to the backend of the safety cover that can be adapted to be attached to the inside of the outlet cover. The use of pistons to achieve a compression response to exertion of force is well known. Therefore, one skilled in the art can easily adapt a piston for use as a compression device in this invention. Those skilled in the art will recognize other compression devices for the internal safety device.

Figure 7:
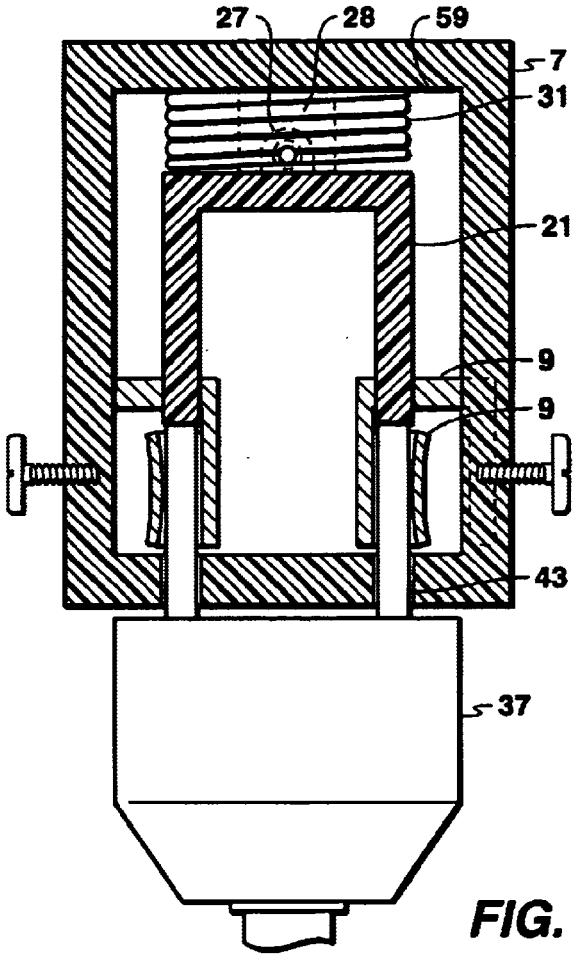
FIG. 7 is an exploded top view showing properly inserted plug into an electrical outlet with safety cover retracted and in the open disposition and prongs of the plug fully inserted and held in place by pressure from the electrical contacts.

As shown in FIG. 7, the safety cover is designed to fit inside the conducting electric metal contacts or the conductive track of the conductive members 9 of the electrical outlet 15. FIG. 7 illustrates the invention when a plug 37 is inserted. The prongs 43 of the plug when inserted in the openings of the electrical outlet, force the safety cover 21 back by compressing the spring 31.

FIG. 6 illustrates a safety cover 21 in the closed position 41 and an internal safety cover in the open disposition 42 or with the compression device 24 compressed. Most electrical outlets on the market currently have a construction to hold plug firmly inside the conductive members 9 but only when plug 37 is fully inserted. Preferably, the compression device 24 (e.g., spring or piston) shall exert enough force to eject partially inserted plugs 37 but not enough force to eject a fully inserted plug 37 held in place by the force from the electrical conductive members 9 and/or from other parts of the electrical outlet. Accordingly, the pressure applied by the compression device 24 attached to the safety cover 21 will eject partially inserted plug 37. However, the plug 37 when inserted fully is held by the force exerted on the prongs 43 from the metal contacts on the conductive member 9 and/or from other parts of the electrical outlet.

Figure 8:
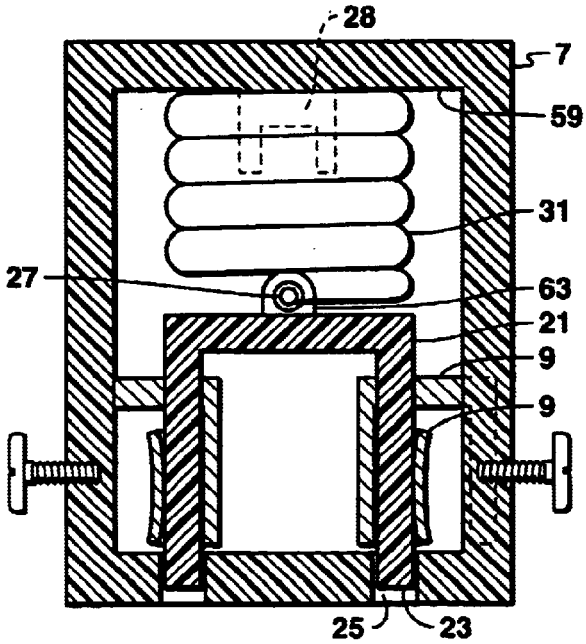
FIG. 8 is an exploded top view of the conventional electrical outlet illustrating the position of the internal safety cover when the safety cover is in the closed disposition.

FIG. 8 is an exploded top view of the invention. The figure shows the housing 7 of the electrical outlet 15 containing a spring 31 attached to the rear inside 59 of the housing 7. Inside the spring 31, a spring guide 28 may be installed to help insure proper guidance of the spring 31 during compression (as shown in FIG. 7) and decompression (as shown in FIG. 8) of the spring 31. The spring 31 may be attached to the safety cover 21 either directly or preferably is attached to a pivot 27 that is secured to the backend 29 of the safety cover 21. The pivot 27 may provide additional guidance of the safety cover 21 sliding in and out of the conductive track of the electrical contacts 9. However, the pivot's 27 main purpose is to prevent the movement of the safety cover 21 unless uniform force is applied to both prongs 23 of the safety cover 21. This is because uneven pressure on the prongs 23 of the safety cover 21 will cause the pivot 27 to rotate on its axis and not the spring 31 preventing movement of the safety cover 21.

Figure 9:
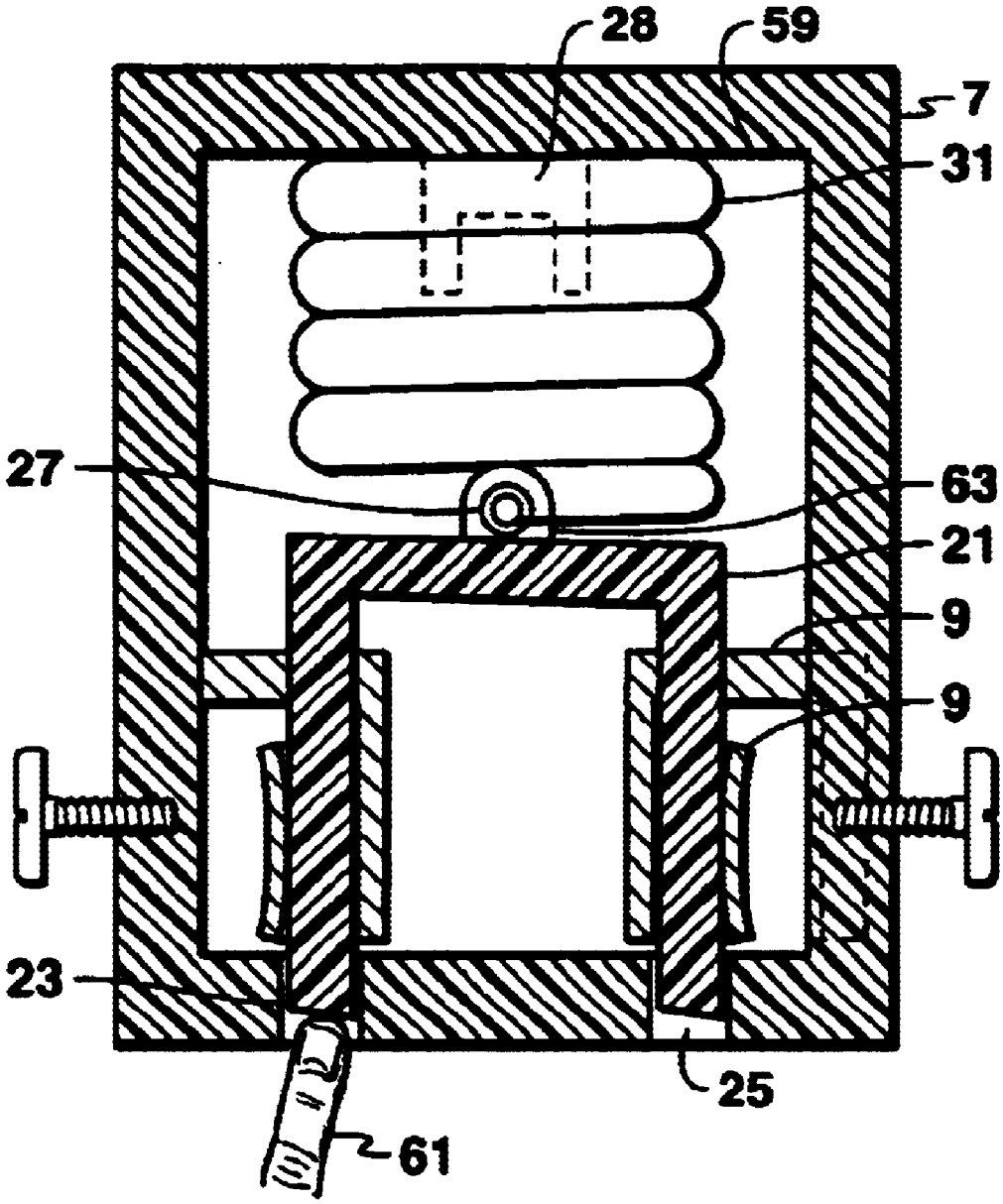
FIG. 9 is an exploded top view of internal safety cover in closed position with the openings of electrical outlet protected illustrating the pivoting action of the safety cover pivot embodiment.

FIG. 9 illustrates the response of the safety device due to uneven force in one or both of the apertures. When a foreign object 61 is inserted in one of the openings 25 of an electrical outlet 15 outlets a force is exerted on one side of the safety cover 21 that force moves one prong 23 of the internal safety cover 21 back but not the other prong 23 of the safety cover 21. Due to the action of the pivot 27 the safety cover 21 rotates and friction resistance from the prongs of the safety cover 21 contacting the sides of the conducting members 9 prevents the cover from sliding back and exposing the hot electrical contacts 9. This prevents the safety cover 21 from sliding back unless uniform force is applied to both openings. Exertion of uniform force on both openings is unlikely unless a properly pronged plug 34 is inserted in the openings 25 of the electrical outlet 15.

As shown in FIG. 9, in one embodiment, the pivot 27 is a round device that rotates from its axis. In the embodiment shown in FIG. 9, the pivot 27 has a pin (not shown) inserted at or near the center of the pivot 27 in a hollow axis. The pivot 27 is attached to a pivot bracket 63 that may then be attached to the back end 65 of the safety cover 21. The pivot 27 rotates in a circular manner around the pivot pin that is usually in the center of the pivot 27. Persons skilled in the art will recognize other pivot mechanisms that achieve a similar response to the embodiment discussed above.

Referring to FIG. 9, the pivot 27 prevents objects from being inserted in one side only due to the rotation of the pivot 27 forcing the internal safety cover 21 to rotate into the conductive members 9 and preventing further movement of the internal safety cover 21. A proper-pronged plug 37 will open the safety cover 21 because the prongs 43 of a plug 37 when guided by the openings 25 of the electrical outlet 15 will exert uniform force on the prongs 23 of the internal safety cover 21 forcing compression of the compression device 24 regardless of any rotation of the pivot 27. If uneven pressure is applied to internal safety cover 21 from a foreign object 61 (i.e., a child's finger) the pivoting action of the safety cover attached to the spring 31 will rotate prohibiting movement of the safety cover 21. Therefore, the pivot prevents any object from being inserted other than an object exerting simultaneous uniform pressure on both prongs 23 of the safety cover 21 (i.e., insertion of a proper electrical pronged plug 37). FIG. 9 illustrates how when a finger 61 or object not designed for electrical outlets 15 is inserted, the pivoting action prohibits sliding movement of the safety cover 21 preventing exposure to the conducting members 9.

Figure 10:
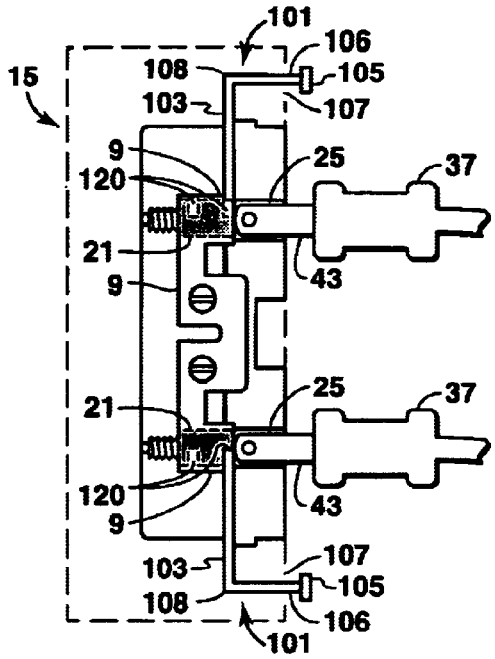
FIG. 10 is an elevation section schematic of the electrical outlet illustrating the latch mechanism and the safety cover in the open disposition.

As shown in FIG. 10, an embodiment involves the use of a safety latch mechanism 101. The safety latch 101 provides a catch or finger 103 to prevent the electrical outlet internal safety cover 21 from moving. This could prevent a child from inserting an object in the receptacle when activated.

The latch mechanism 101 is slidably carried by housing 15 and includes a latch operator 105 with a stem 106 (FIGS. 10, 11, 12 and 13) that extends down from operator 105 through a slit 107 provided through the face of cover 1 of housing 15 to terminate in a finger 108 having a distal end 103 that extends out towards the safety cover 21. One or more spaced indentations or notches 120 are provided in a side wall of the safety cover 21 each sized, disposed and configured to receive distal end 103 of finger 108.

Figure 13:
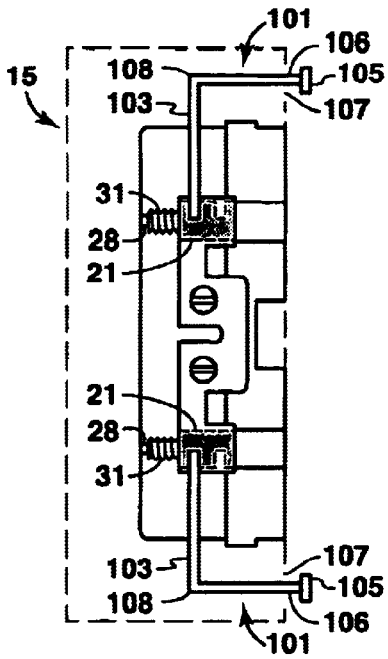
FIG. 13 is an elevation section schematic of the electrical outlet illustrating the latch mechanism and the safety cover in the closed disposition.
Figure 11:
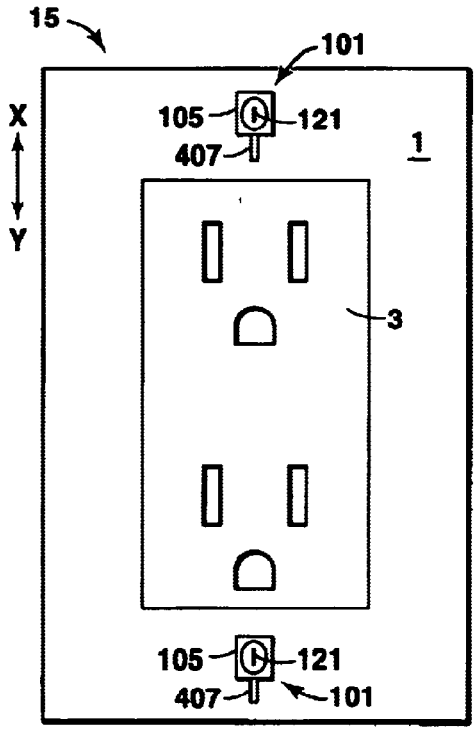
FIG. 11 is a schematic plan view of the electrical outlet of FIG. 10.
Figure 12:
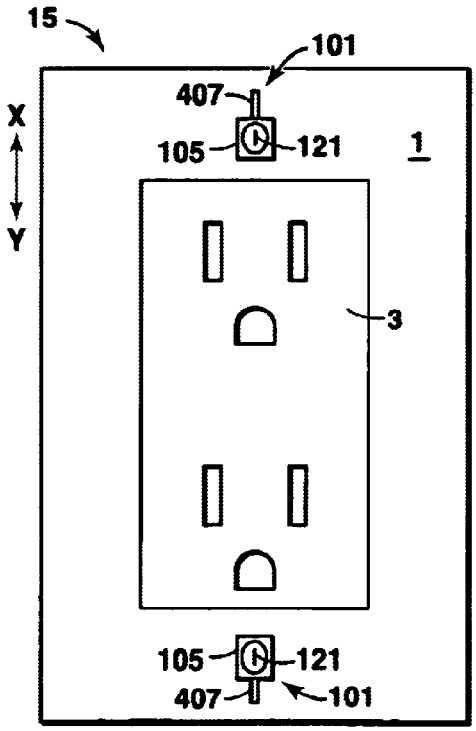
FIG. 12 is a schematic plan view of the electrical outlet of FIG. 13.

When safety cover 21 is in the closed or open disposition the operator 105 may be moved in the direction of arrow "Y" (FIGS. 11 and 12) sliding its stem 106 in slit 107 until distal end 103 of finger 108 enters a notch 120 (FIGS. 10 and 13) and latches the safety cover 21 in either an open (FIG. 10) or closed disposition (FIG. 13). Prior to moving the safety cover 21 from its closed disposition (FIG. 13) to its open disposition (FIG. 10) operator 105 is moved in the direction of arrow X (FIGS. 11 and 12) moving its stem 106 in slit 107 until distal end 103 of finger 108 moves out of notch 120 and away from safety cover 21, which is thereafter free to be moved to its open disposition.

The application of suitable pressure to the safety cover 21 moves the safety cover to the back of the electrical outlet 59 (FIG. 7) from its closed disposition (FIG. 8) to its open disposition (FIG. 7) against the action of the compression device 31. When the safety cover 21 is in its open disposition operator 105 can be again slid in the direction of arrow Y (FIGS. 11 and 12) to place distal end 103 of finger 108 in upper notch 120 of the safety cover 21 to latch safety cover 21 in its open disposition (FIG. 7). Subsequent movement of operator 105 in the direction of arrow X (FIGS. 11 and 12) will move end 103 of finger 108 out of notch 120 and permit the action of the compression device 31 to lift the safety cover 21 back into its closed disposition where it may be latched by operation of operator 105 as described above. As an alternative to the notches 120 in the safety cover 21 the latch mechanism can be arranged to slidably fit behind the safety cover 21 to prevent movement of the safety cover away from the closed disposition.

Once the latch mechanism 101 is engaged while the safety cover is in the closed disposition the latch mechanism 101 will prevent movement of the safety cover 21 therefore denying access to the receptacle and the hot electrical contact 9. For additional safety the latch 101 can be locked to prevent access to the outlet without a key. Such locks 121 are known in the art and can be easily and inexpensively made by persons skilled in the art.

Although the embodiments discussed above are primarily for the beneficial effects of the invention when applied to electrical outlets, this should not be interpreted to limit the claimed invention which is applicable to any mating or junction device where a signal is sent and prevention of said signal can be obtained with an internal safety cover. Those skilled in the art will recognize many equivalent variations that are included in the scope of the claims.

What is claimed is:

1. An internal safety cover comprising a backend connected to at least one non-conducting prong wherein said backend is attachable to the inside of a socket body of an electrical outlet and said prong slidably fits inside a conductive track of a conductive member of said electrical outlet.

2. The apparatus of claim 1 wherein said internal safety cover is connected to the inside of said socket body by a compression device.

3. The apparatus of claim 2 wherein said compression device is a spring.

4. The apparatus of claim 2 wherein said compression device is a piston.

5. The apparatus of claim 2 wherein said compression device is attached to said internal safety cover by a pivot.

6. The apparatus of claim 2 wherein said safety cover has two prongs and each prong slidably fits inside said conductive member of said electrical outlet.

7. The apparatus of claim 5 wherein said safety cover has two prongs and each prong slidably fits inside said conductive member of said electrical outlet and said pivot has a pivot pin at or near the center of said pivot and said pivot pin is attached to said compression device and said pivot is attached to said internal safety cover by said pivot bracket.

8. An electrical outlet comprising:

(a) a socket body;

(b) at least one conducting member connectable with a power source, said conducting member comprising a conductive track; and (c) an internal safety cover comprising a backend connected to at least one non-conducting prong wherein said backend of said safety cover is attached to the inside of said socket body by a compression device wherein said prong of said internal safety cover is slidably inside said conductive track of said conducting member.

9. The apparatus of claim 8 wherein said compression device is a spring.

10. The apparatus of claim 8 wherein said compression device is a piston.

11. The apparatus of claim 8 wherein said safety cover is attached to said compression device by a pivot.

12. The apparatus of claim 11 wherein said compression device is attached to said safety cover by attaching said compression device to a pivot pin inside said pivot, said pivot attached to said safety cover by a pivot bracket.

13. The apparatus of claim 9 wherein a spring guide is located inside said spring to guide said spring and said safety cover.

14. The apparatus of claim 8 wherein said safety cover is adapted to slide inside the metal contact of said electrical outlet.

15. The apparatus of claim 8 wherein said electrical outlet has two conductive members each comprising a conductive track and said safety cover has at least two prongs, each prong of said safety cover slidably fits inside said conductive track of said conductive member.

16. The apparatus of claim 8 further comprising a latch mechanism said latch mechanism comprising a finger wherein said finger prevents movement of the safety cover when said latch mechanism is engaged.

17. The apparatus of claim 8 further comprising a latch mechanism said latch mechanism comprising a finger and said safety cover has at least one notch to receive said finger of said latch mechanism when said latch is engaged.

18. The apparatus of claim 8 wherein said compression device provides at least enough force to eject partially inserted plugs but not enough force to eject a fully inserted plug.

19. A method of providing power and protecting against electrical shocks from an electrical outlet comprising the steps of:

(a) providing an electrical outlet comprising a socket body and at least one coupling part with a conductive member comprising a conductive track said conductive member connectable with a power source and being sized and configured to be coupled to a complimentary plug comprising at least one prong, an internal safety cover comprising a backend and at least two non-conducting prongs slidably inside said conductive member, said backend of said safety cover is attached to a compression device which is attached to the rear inside of said socket body;

(b) inserting said plug into said coupling part whereby said force exerted by prongs of said plug compresses said spring attached to said safety cover permitting said safety cover to slide in a conductive track of said conductive member of said coupling part, exposing said conductive member to said plug; and (c) providing power from said electrical outlet to said plug in contact with said conductive member of said outlet.

20. The method of claim 19 further comprising the step of ejecting a partially inserted plug.

21. The method of claim 19 further comprising the steps of providing a latch mechanism and activating said latch to prevent movement of said safety cover.

22. The method of claim 19 further comprising the steps of providing a latch mechanism comprising a finger and notches in said safety cover to receive said finger of said latch mechanism and activating said latch mechanism wherein said notch of said safety cover receives said finger preventing movement of said safety cover.

23. The method of claim 19 further comprising the steps of providing a pivot with a pivot pin in the center of said pivot, said pivot is attached to said safety cover by said pivot bracket, said pivot pin is attached to said spring, rotating said pivot as uneven pressure is exerted on said safety cover wherein at least one prong of said safety cover contacts a side of said conductive track of said conductive member of said electrical outlet and friction between said safety cover and said conductive member prevents movement of said safety cover.

* * * * *